US010199775B2

(12) United States Patent
Zhao et al.

(10) Patent No.: US 10,199,775 B2
(45) Date of Patent: Feb. 5, 2019

(54) ELECTRICAL CONNECTOR WITH DEVICE SECURING SHIELDING PLATE AND INSULATOR TOGETHER BEFORE MOLDING

(71) Applicant: FOXCONN INTERCONNECT TECHNOLOGY LIMITED, Grand Cayman (KY)

(72) Inventors: Jun Zhao, HuaiAn (CN); Jing-Jie Guo, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/399,758

(22) Filed: Jan. 6, 2017

(65) Prior Publication Data

US 2017/0194750 A1 Jul. 6, 2017

(30) Foreign Application Priority Data

Jan. 6, 2016 (CN) ..... 2016 1 0002585

(51) Int. Cl.

| | |
|---|---|
| ***H01R 24/60*** | (2011.01) |
| ***H01R 13/6585*** | (2011.01) |
| ***H01R 13/405*** | (2006.01) |
| *H01R 107/00* | (2006.01) |
| *H01R 13/6594* | (2011.01) |

(52) U.S. Cl.

CPC ..... *H01R 13/6585* (2013.01); *H01R 13/405* (2013.01); *H01R 24/60* (2013.01); *H01R 13/6594* (2013.01); *H01R 2107/00* (2013.01)

(58) Field of Classification Search

CPC ..... H01R 24/60; H01R 2107/00; H01R 13/6585; H01R 12/724; H01R 13/6594; (Continued)

(56) References Cited

U.S. PATENT DOCUMENTS 9,022,800 B2 * 5/2015 Yang ..... H01R 13/6581 439/487
9,209,573 B1 * 12/2015 Chen ..... H01R 13/6581
(Continued)

FOREIGN PATENT DOCUMENTS

| | | |
|---|---|---|
| CN | 204011986 | 12/2014 |
| CN | 204243301 | 4/2015 |
| CN | 204315771 | 5/2015 |

*Primary Examiner* — Amy Cohen Johnson
*Assistant Examiner* — Matthew T Dzierzynski
(74) *Attorney, Agent, or Firm* — Wei Te Chung; Ming Chieh Chang

(57) ABSTRACT

An electrical connector includes an insulative housing, upper and lower contacts disposed in the housing, a metallic shielding plate, and a metallic shield enclosing the housing. The insulative housing includes a first insulator with a first mating tongue thereof, and a second insulator with a second mating tongue thereof wherein the shielding plate is sandwiched between the first insulator and the second insulator. The shielding plate forms a cutout with side edges in two opposite lateral sides. The second insulator forms a pair of pressing parts extending toward the shielding plate with a hook at the end. When the shielding plate is assembled to the second insulator, the hook engages the side edge of the cutout so as to secure the shielding plate to the second insulator in the vertical direction.

13 Claims, 8 Drawing Sheets

(58) Field of Classification Search
CPC ..... H01R 13/405; H01R 13/6581; H01R 12/716; H01R 13/6587; H01R 13/6593; H01R 24/28; H01R 24/62; H01R 12/707; H01R 13/6471; H01R 13/6597; H01R 12/712; H01R 12/721; H01R 13/504; H01R 13/5202; H01R 13/6476; H01R 13/6477; H01R 13/6582; H01R 13/6591; H01R 23/02; H01R 23/7073; H01R 24/78; H01R 43/16; H01R 43/18; H01R 4/02; H01R 12/58; H01R 12/585; H01R 12/7005; H01R 12/71; H01R 12/722; H01R 13/42; H01R 13/428; H01R 13/501; H01R 13/521; H01R 13/6273; H01R 13/642; H01R 13/6461; H01R 13/6474
USPC ..... 439/607.05, 487, 607.01, 607.35, 78
See application file for complete search history.

(56) References Cited

U.S. PATENT DOCUMENTS 9,214,766 B1 * 12/2015 Yu ..... H01R 13/6585
9,231,356 B1 * 1/2016 Ju ..... H01R 24/78
9,276,365 B2 * 3/2016 Yu ..... H01R 24/70
9,306,336 B2 * 4/2016 Chang ..... H01R 13/6471
9,306,337 B2 * 4/2016 Yu ..... H01R 24/60
9,466,924 B2 * 10/2016 Lin ..... H01R 13/6585
9,466,930 B2 * 10/2016 Little ..... H01R 24/60
9,478,915 B2 * 10/2016 Guo ..... H01R 13/6585
9,484,679 B2 * 11/2016 Guo ..... H01R 13/6585
9,490,579 B2 * 11/2016 Little ..... H01R 13/642
9,496,664 B2 * 11/2016 Little ..... H01R 13/6587
9,502,821 B2 * 11/2016 Little ..... H01R 13/6582
9,548,568 B2 * 1/2017 Miyoshi ..... H01R 13/428
9,564,716 B2 * 2/2017 Kao ..... H01R 13/6586
9,673,569 B2 * 6/2017 Zhang ..... H01R 13/6585
9,692,166 B2 * 6/2017 Kao ..... H01R 13/42
9,705,217 B2 * 7/2017 Ju ..... H01R 12/712
9,735,511 B2 * 8/2017 Kao ..... H01R 13/5202
2015/0244111 A1 * 8/2015 Ju ..... H01R 13/6585 439/607.05
2015/0255905 A1 * 9/2015 Little ..... H01R 13/6658 439/78
2015/0380868 A1 12/2015 Chen et al.
2016/0064869 A1 * 3/2016 Yu ..... H01R 24/60 439/607.05
2016/0197443 A1 7/2016 Zhang
2016/0233630 A1 8/2016 Cheng et al.
2017/0229810 A1 * 8/2017 Zhang ..... H01R 13/6273

* cited by examiner

ELECTRICAL CONNECTOR WITH DEVICE SECURING SHIELDING PLATE AND INSULATOR TOGETHER BEFORE MOLDING

BACKGROUND OF THE INVENTION

1. Field of the Invention

The present invention relates to an electrical connector, and particularly to a flippable connector and the method of making the same.

2. Description of Related Arts

Chinese Patent No. CN204289826U issued on Apr. 22, 2015, discloses a flippable connector including a combined module and a metallic shield enclosing the combined module. The combine module includes a first insulator having a first mating tongue thereon, and a second insulator having a second mating tongue thereon, and a metallic shielding plate sandwiched between the first insulator and the second insulator. The first insulator and the second insulator are secured together. The first mating tongue includes a fixing post and the second mating tongue includes a securing hole through which the fixing post extends and is further riveted so as to secure the first mating tongue and the second mating tongue together. Chinese Patent No. CN204464643U issued on Jul. 08, 2015, discloses a flippable connector including a first insulator, a second insulator, a third insulator wrapping both the first insulator and the second insulator, a metallic shielding plate sandwiched between the first insulator and the second insulator, and a metallic shield enclosing all the first insulator, the second insulator and the third insulator. The first insulator includes a first fixing post and a first fixing hole, and the second insulator includes a second fixing post and a second fixing hole. The shielding plate includes an escaping hole. The first fixing post extends through the escaping hole into the second fixing hole, and the second fixing post extends through the escaping hole into the first fixing hole.

The securing made by the fixing post received within the corresponding fixing hole in an interference fit may be unstable during the high pressure insert-molding process to apply the third insulator upon the stacked first insulator and second insulator, thus resulting in the defective assembly. An improvement overcoming such defect is desired.

SUMMARY OF THE INVENTION

Accordingly, an object of the present invention is to provide an effective securing between the first insulator and the second insulator when applying the third insulator thereupon. An electrical connector includes an insulative housing, upper and lower contacts disposed in the housing, a metallic shielding plate, and a metallic shield enclosing the housing. The insulative housing includes a first insulator with a first mating tongue thereof, and a second insulator with a second mating tongue thereof wherein the shielding plate is sandwiched between the first insulator and the second insulator. The shielding plate forms a cutout with side edges in two opposite lateral sides. The second insulator forms a pair of pressing parts extending toward the shielding plate with a hook at the end. When the shielding plate is assembled to the second insulator, the hook engages the side edge of the cutout so as to secure the shielding plate to the second insulator in the vertical direction.

The hook extends beyond the corresponding side edge and downwardly abuts against the shielding plate.

The first mating tongue includes an engaging hole, the second mating tongue includes an engaging block located between the pair of pressing parts. When the first mating tongue is assembled upon the shielding plate, the engaging block is engaged within the engaging hole along the vertical direction.

The second mating tongue includes an engaging slot in which the engaging block is located. The first mating tongue includes a protrusion received within the engaging slot.

The first mating tongue further includes a pair of posts located by two sides of the protrusion.

The first mating tongue includes a first fixing post and a first fixing hole, the second mating tongue includes a second fixing post and a second fixing hole, and the shielding plate includes an escaping hole wherein the first fixing post and the second fixing post extend through the escaping hole into the corresponding second fixing hole and first fixing hole.

The second mating tongue includes a pair of alignment blocks and a pair of projections. The first insulator includes a pair of recesses receiving the pair of projections, respectively.

A method of making an electrical connector comprising the following steps: S1) providing a first terminal module with a plurality of first contacts embedded within the first insulator, a second terminal module with a plurality of second contacts embedded within the second insulator, a metallic shield plate wherein the first insulator includes a first mating tongue and the second insulator includes a second mating tongue, the first mating tongue including an engaging hole, the second mating tongue including an engaging block, a pair of pressing parts each equipped with a hook at an end, the shielding plate forming a cutout; S2) assembling the shielding plate upon the second terminal module by the hook engaged with a side edge of the shielding plate around the cutout: S3) assembling the first terminal module upon the shielding plate by the engaging block received within the engaging hole.

Other objects, advantages and novel features of the invention will become more apparent from the following detailed description when taken in conjunction with the accompanying drawings.

DETAILED DESCRIPTION OF THE PREFERRED EMBODIMENT

Figure 1:
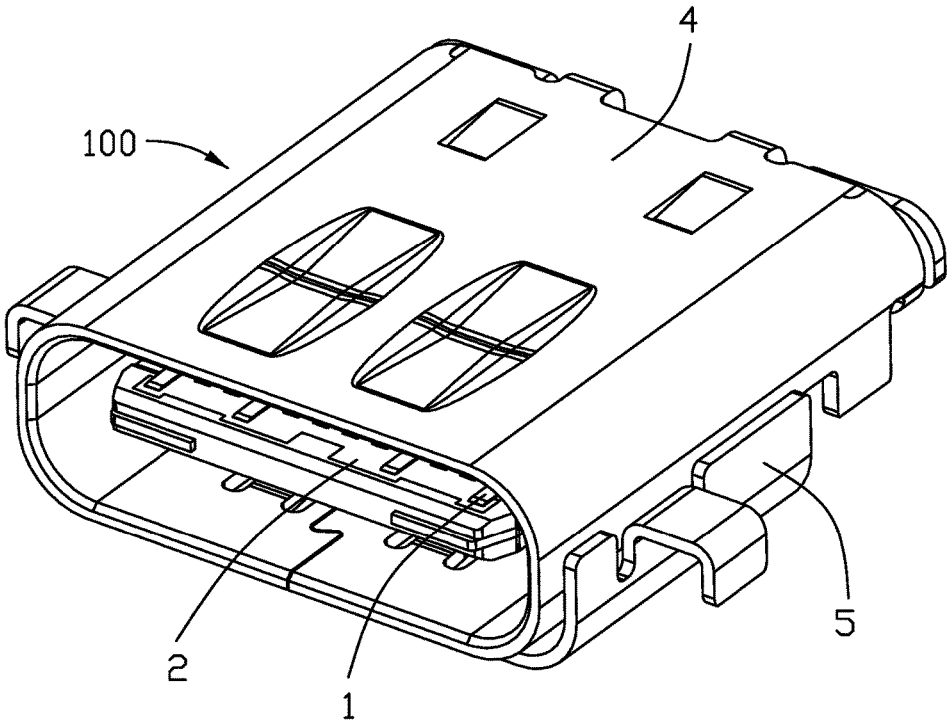
FIG. 1 is a perspective view of the electrical connector of the invention.

Reference will now be made in detail to some preferred embodiments of the present invention.

Referring to FIGS. 1-8, an electrical connector 100 includes an insulative housing 1, a plurality of contacts disposed in the housing 1, a metallic shield plate 3 embedded within the insulative housing 1, a metallic shield 4 enclosing the housing 1, a metallic bracket 5 mounted upon the shield 5 and a sealer attached upon the housing 1. The following description refers to the mating direction, the transverse direction perpendicular to the mating direction, and a vertical direction perpendicular to both the mating direction and the transverse direction.

The insulative housing 1 includes a first insulator 11, a second insulator 12 and a third insulator 13. The first insulator includes a first base 111 and a first mating tongue 112 forwardly extending therefrom. The first base 111 forms the guiding slot 113 and an opening 114 communicating with the guiding slot 113. A pair of recesses 115 are formed in two opposite sides of the first base 111. An engaging hole 116 is formed in a front portion of the fist mating tongue 112. A plurality of first fixing holes and a plurality of first fixing posts 118 are formed upon a surface of the first mating tongue 112 facing the second insulator 12. A protrusion 1191 and a pair of posts 1192 by two sides of the protrusion 1191 are commonly located at a front end of the first mating tongue 112.

The second insulator 12 includes a second base 121 and a second mating tongue 122 extending forwardly therefrom. A pair of alignment blocks 123 are formed on two opposite sides of the second mating tongue 122. Another opening 124 is formed in the second base 121 corresponding the opening 114. A pair of projections 125 are located on the rear portion of the second base 121 for engagement with the recesses 115. The second mating tongue 122 forms an engaging slot 120 and an engaging block 126 located in the engaging slot 120 and extending into the corresponding engaging hole 116. A plurality of second fixing holes 127 for receiving the corresponding first fixing posts 118, and a plurality of second fixing posts 128 for extending into the corresponding first fixing holes 117, are formed upon a surface facing the first insulator 11. The second mating tongue 122 includes around a front end, a pressing part 129 extending in the vertical direction with a transversely extending hook 1291 at an end. The alignment block 123 is located between the corresponding projection 125 and second fixing post 128.

The third insulator 13 includes a third base 131 and a third mating tongue 132 extending forwardly therefrom. The third mating tongue 132 includes a cavity 133 to receive the first mating tongue 112 and the second mating tongue 122, and a pair of locking notches 134 and two pairs of securing slots 135.

Referring to FIGS. 2-7, the contacts 2 includes a plurality of first contacts 21 retained in the first insulator 11, and a plurality of second contacts 22 retained in the second insulator 12. The first contact 21 includes the first contacting section 211 exposed upon the first mating tongue 112, an obliquely extending first retention section 212 disposed in the first base 111, and a first soldering section 213 extending out of the housing 1. The second contact 22 includes the second contacting section 221 exposed upon the second mating tongue 122, the second retention section 222, and a second soldering section 223 exposed outside of the housing 1. The second contacts 22 are equally located by two sides of the opening 124. The first soldering section 213 and the second soldering section 223 are coplanar with each other. Notably, the contacts 2 are characterized by following the USB (Universal Serial Bus) Type C specification.

Figure 4:
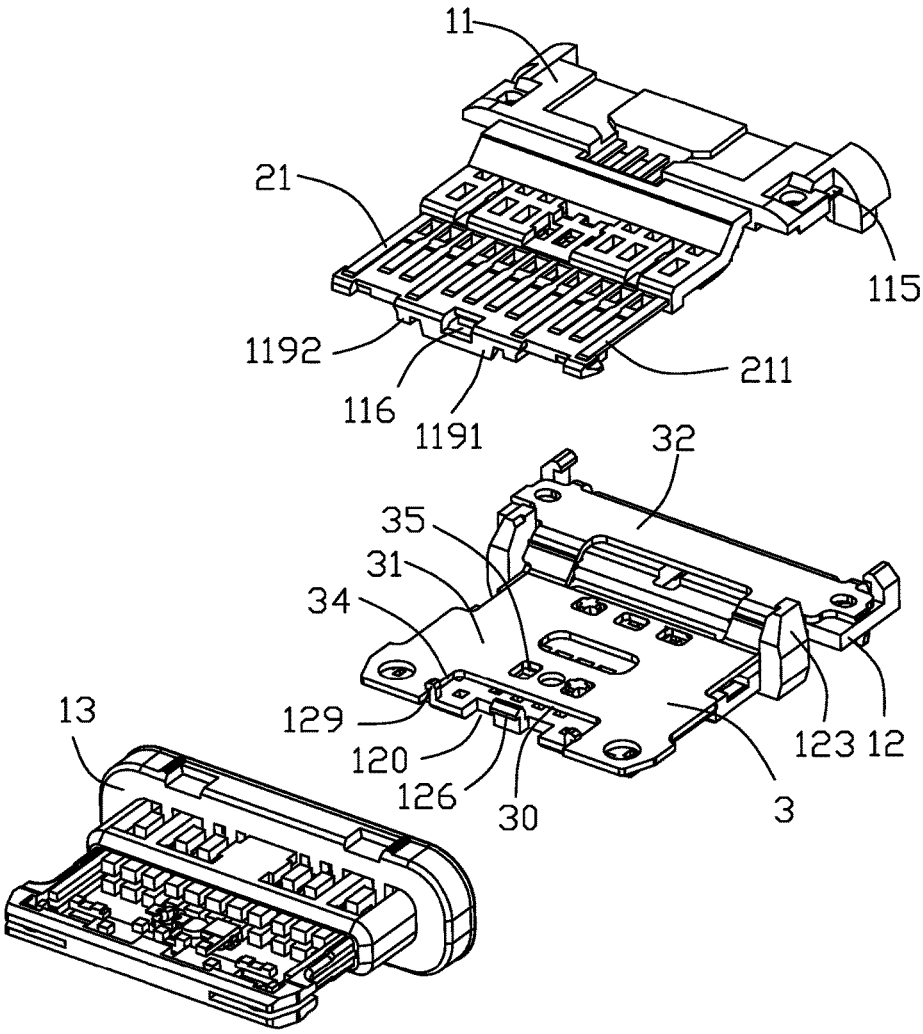
FIG. 4 is an exploded perspective view of the terminal module assembly of the electrical connector of FIG. 1 wherein the shielding plate is assembled upon the second insulator.
Figure 5:
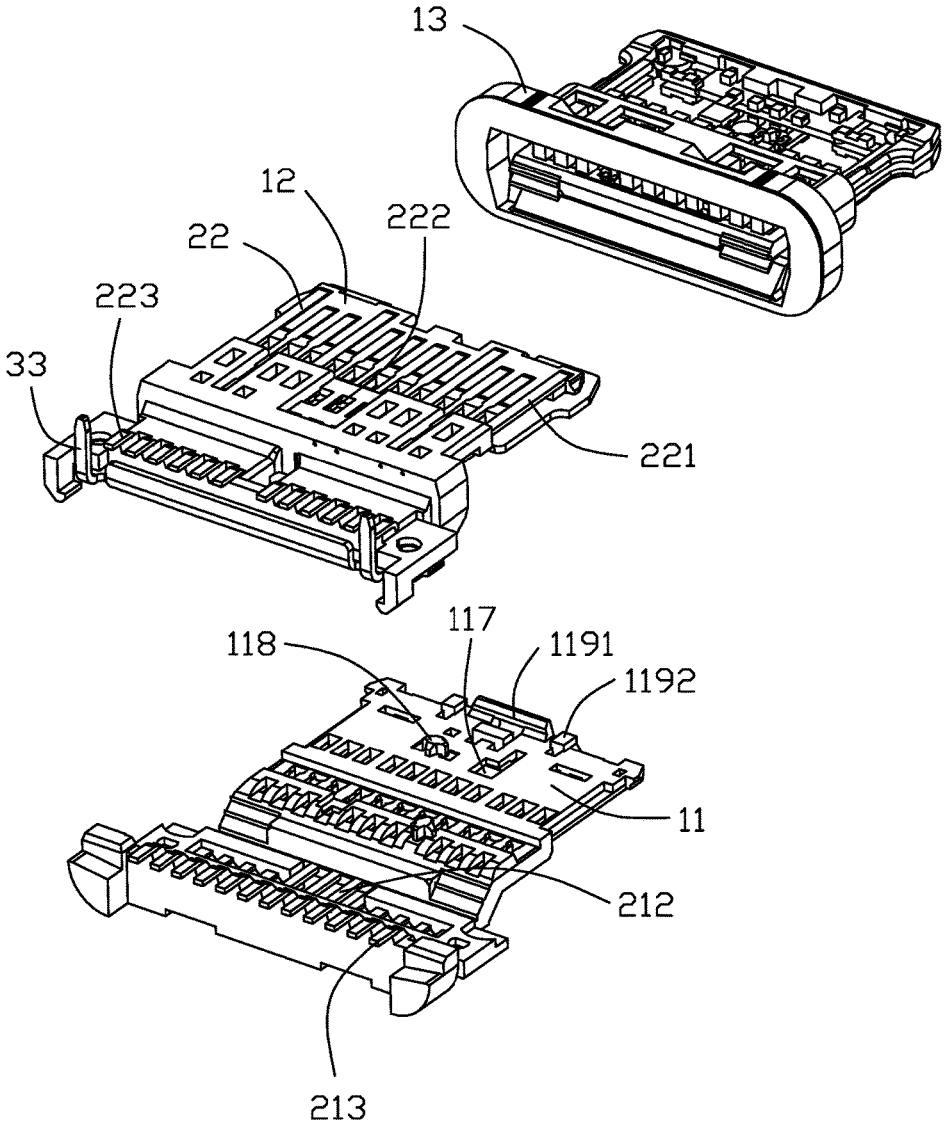
FIG. 5 is another exploded perspective view of the terminal module assembly of the electrical connector of FIG. 4.
Figure 6:
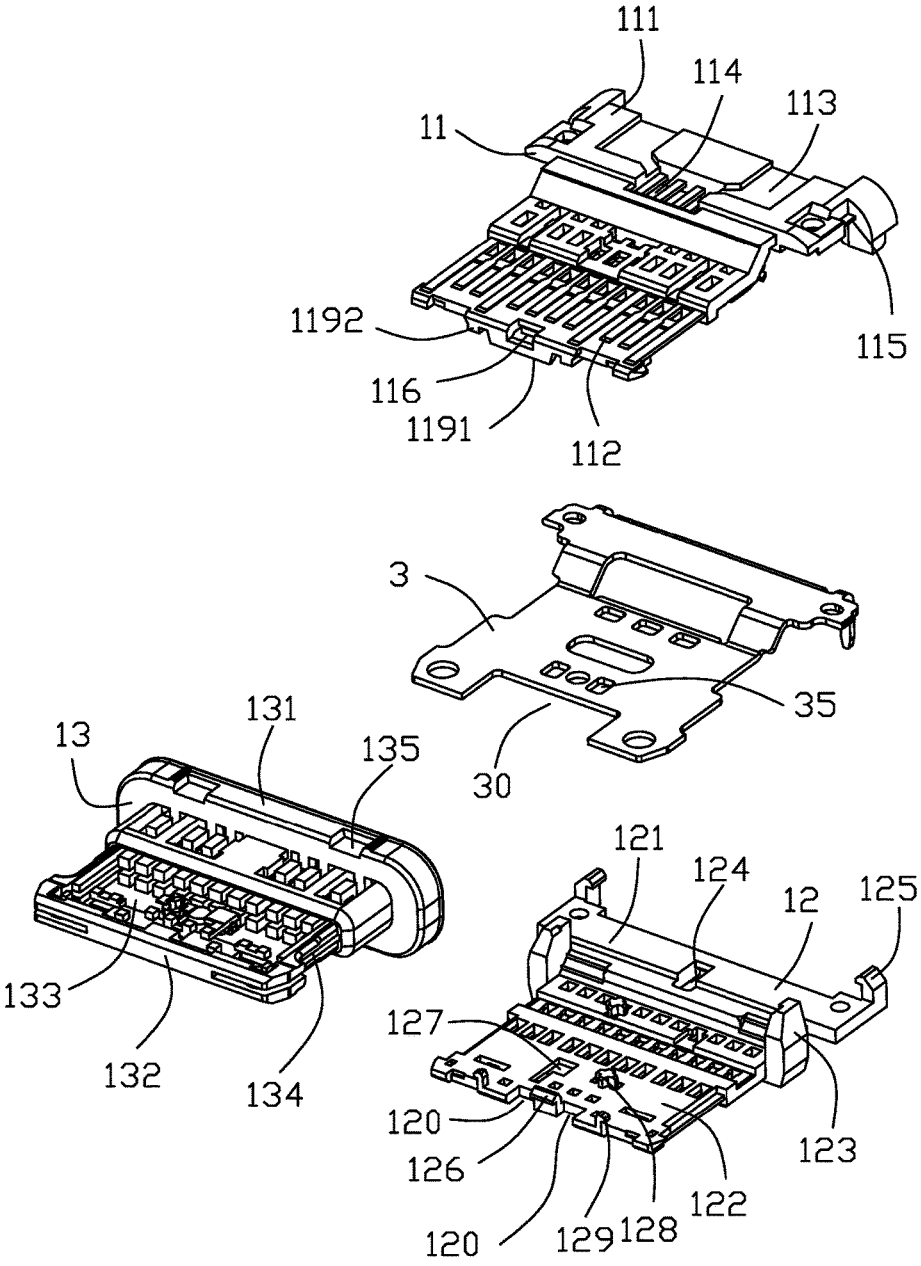
FIG. 6 is a further exploded perspective view of the terminal module assembly of the electrical connector of FIG. 4 wherein the shielding plate is dissembled from the second insulator.
Figure 7:
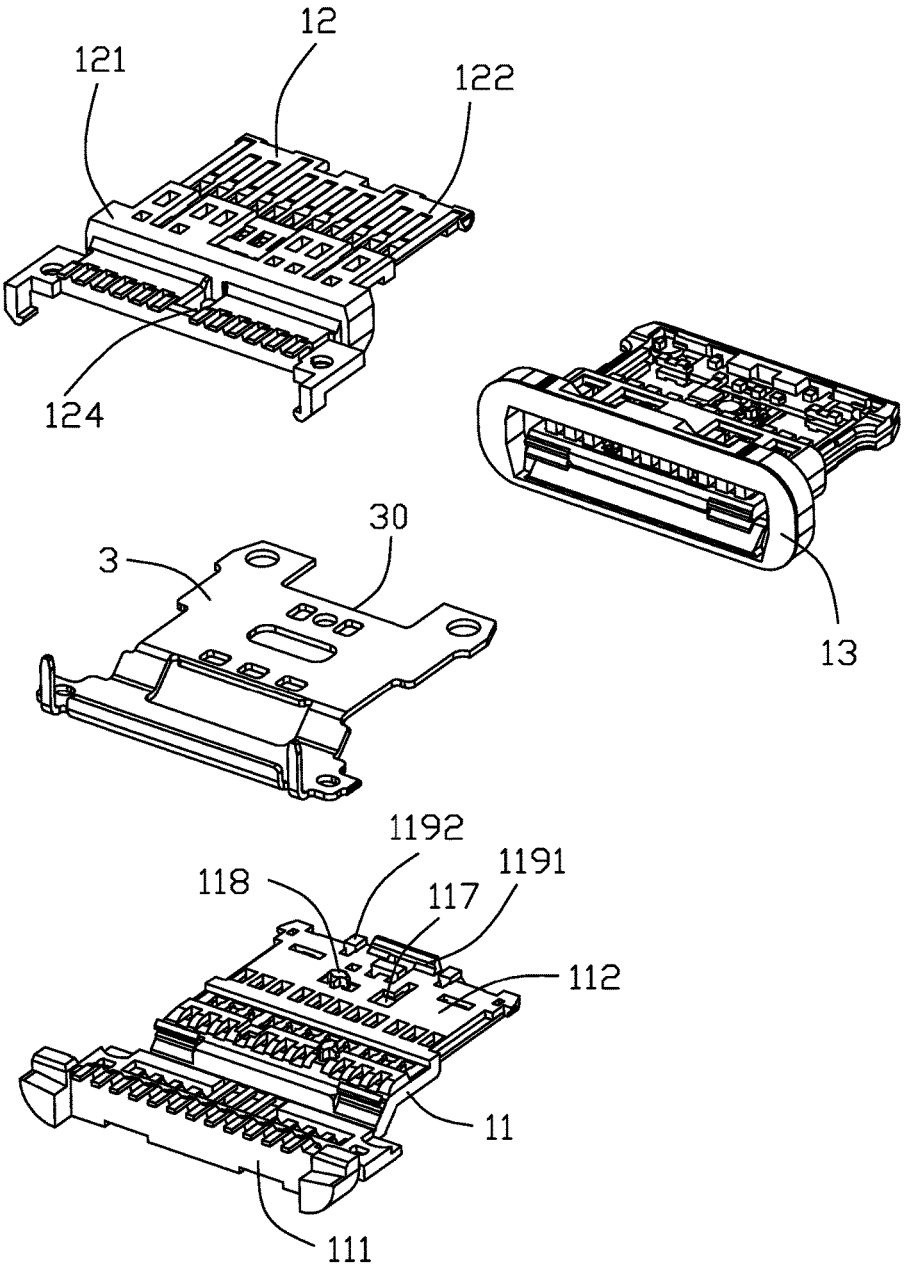
FIG. 7 is another further exploded perspective view of the terminal module assembly of the electrical connector of FIG. 6.
Figure 8:
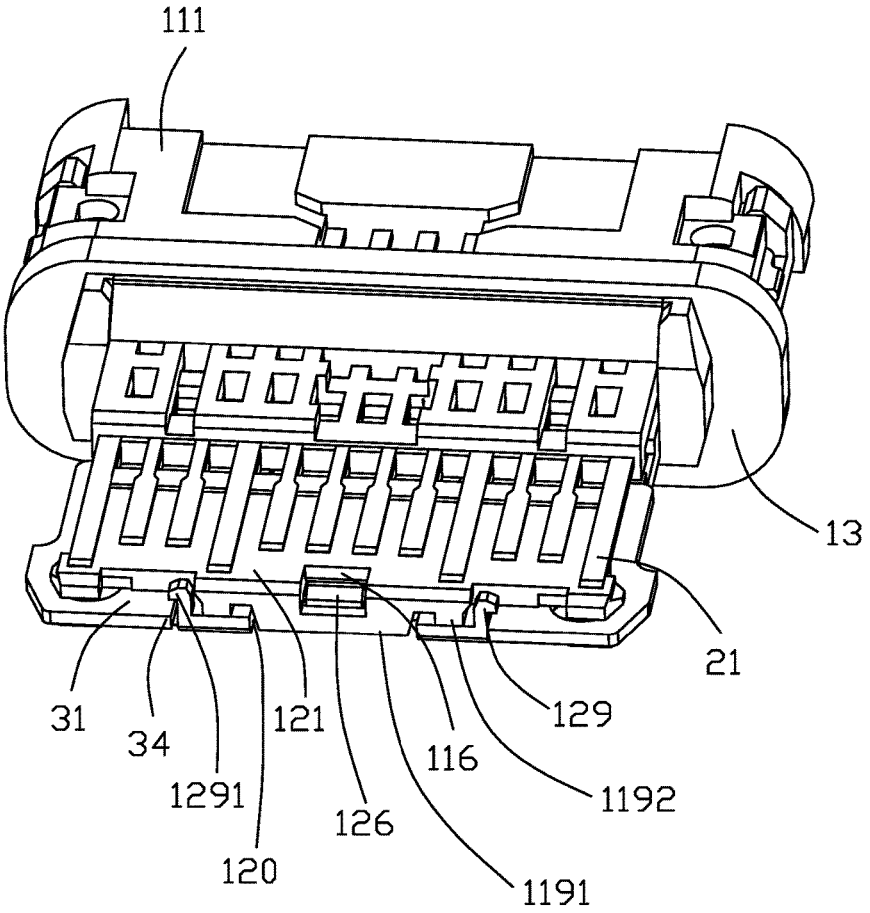
FIG. 8 is a perspective view of the terminal module assembly without the third insulator thereof.

Referring to FIGS. 6 and 7, the shielding plate 3 includes a front section 31 between the first mating tongue 112 and the second mating tongue 122, a middle section 32 extending rearwardly from the front section 31 and a pair of soldering legs 33 extending downwardly from the middle section 32. A cutout 30 is formed in a front end of the shielding plate 3 with a pair of side edges 34. As shown in FIG. 4, the pressing part 129 abuts against the side edge 34, and the hook 1291 downwardly presses the top surface of the side edge 34 for securing the shielding plate 3 and the second insulator 12. The shielding plate 3 forms a plurality of escaping holes 35 through which the first fixing post 118 and the second fixing post 128 extend and further into the corresponding second fixing hole 127 and first fixing hole 117.

Figure 2:
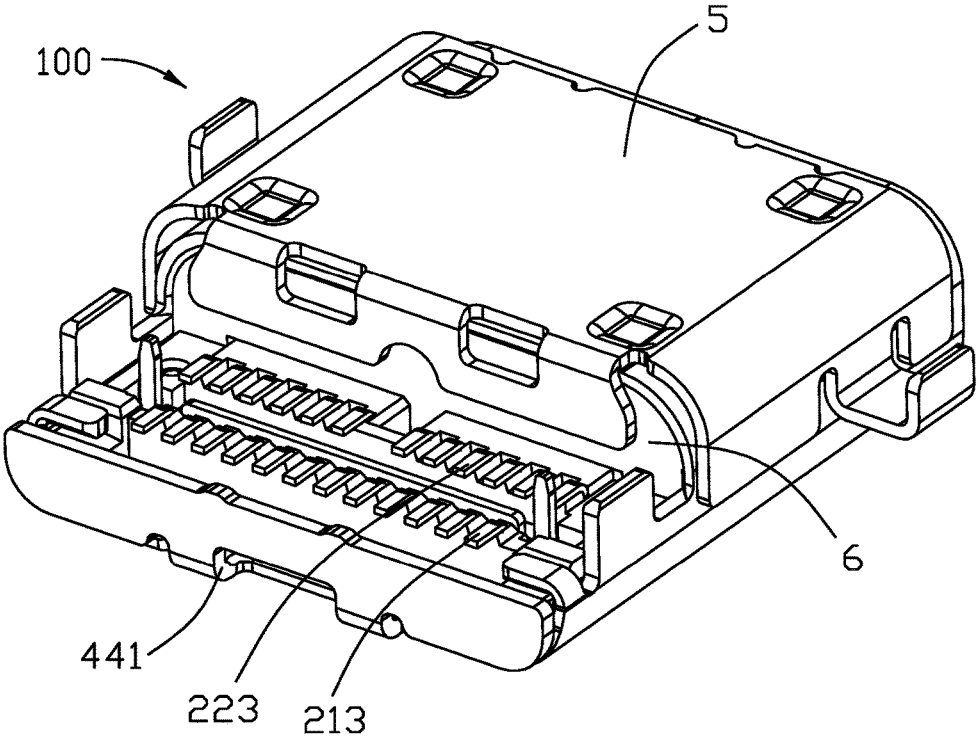
FIG. 2 is another perspective view of the electrical connector of FIG. 1.
Figure 3:
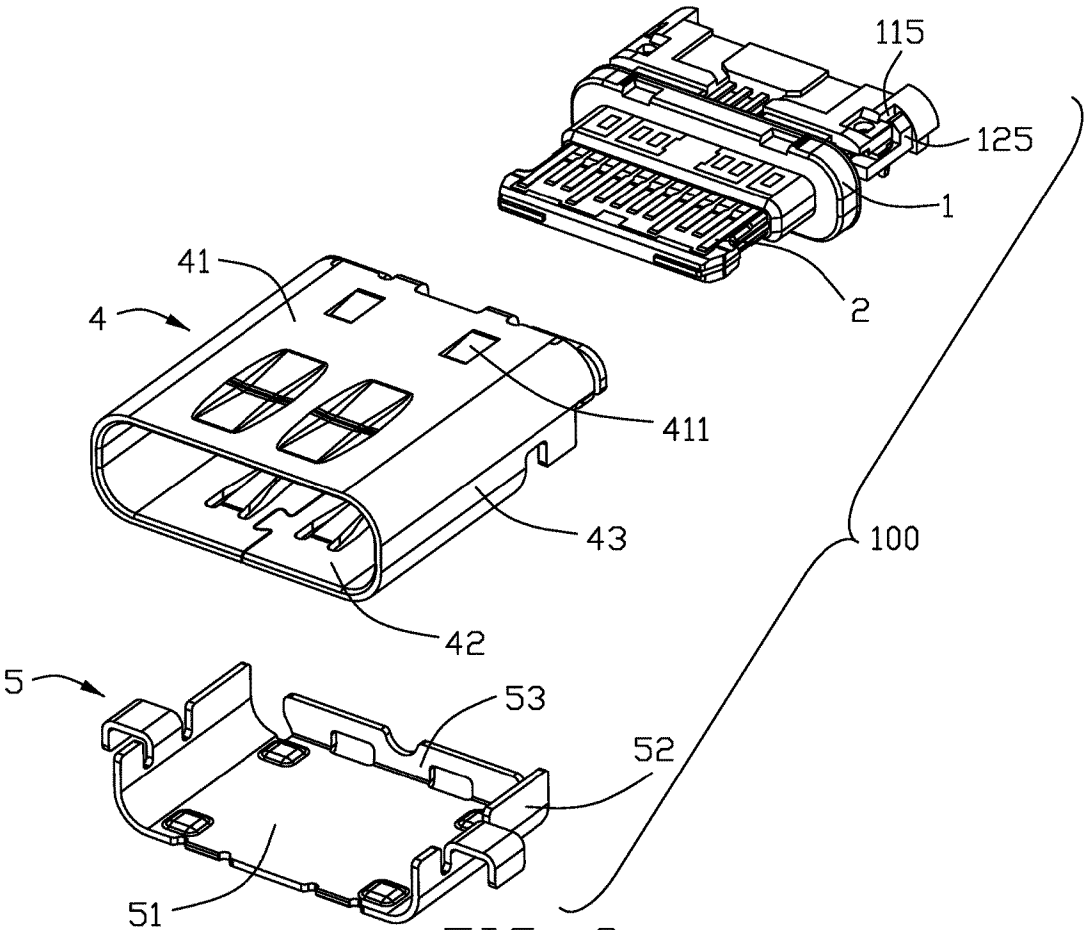
FIG. 3 is an exploded perspective view of the electrical connector of FIG. 1.

Referring to FIGS. 1-3, the metallic shield 4 includes opposite top wall 41 and bottom wall 42, and a pair of side walls 43 linked therebetween. Along the mating direction, the bottom wall 42 is shorter than the top wall 41. The top wall includes a pair of tabs 411 retained in the securing slots 135, respectively. The shield 4 further includes a rear wall 44 spaced from the side walls 43. The rear wall 44 forms an opening 441 corresponding to the openings 114 and 124.

Referring to FIGS. 2-3, the bracket 5 includes a main board 51, and a pair of side boards 52 and a rear board 53 respectively extending from the main board 51. The rear board 53 covers the sealer 6.

The method of making the electrical connector 100 includes the following steps: Step 1) providing a first terminal module (not labeled) with a plurality of first contacts 21 embedded within the first insulator 11 via an insert-molding process, and a second terminal module (not labeled) with a plurality of second contacts 22 embedded within the second insulator 12 via another insert-molding process, and a metallic shielding plate 3; Step 2) assembling the shielding plate 3 upon the second insulator 12 wherein the hook 1291 of the pressing part 129 is engaged with a side edge 34 of the shielding plate 3 for securing the shielding plate 3 with the second insulator 12 in the vertical direction; Step 3) assembling the first insulator 11 upon the shielding plate 3 wherein the first engaging device, i.e., the engaging block 126, extends through the cutout 30 into the corresponding second engaging device, i.e., the engaging hole 116, for securing the first insulator 11 and the second insulator 12 together with the shielding plate 3 therebetween in the vertical direction; at the same time, the protrusion 1191 extending through the cutout 30, is received within the engaging slot 120, the posts 1192 abut against the second insulator 12, the engaging blocks 123 located on two sides of the first insulator 11, the projections 125 are received within the corresponding recesses 115, and the first fixing post 118 and the second fixing post 128 extending through the escaping holes 35 into the corresponding second fixing hole 127 and first fixing hole 117; Step 4) applying a third insulator 13 upon the assembled first terminal module and second terminal module with the shielding plate 3 therebetween via another insert-molding process so as to form a complete terminal module assembly (not labeled) wherein all gaps among the first terminal module, the second terminal module and the shielding plate 3 may be occupied by material of the third insulator 13; Step 5) assembling the shield 4 upon the finalized terminal module assembly and assembling the bracket 5 upon the shield 4: Step 6) injecting glue into the opening 441 to have glue flow through the openings 114 and 124 so as to form the complete sealer 6 on the back of the connector 100. It is noted that even though the engaging block 126 and the pressing part 129 are deflectable during the engagement procedure before the third insulator is applied thereon, both of them are bound by the third insulator 13 without deflection permanently in the final terminal module assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a terminal module assembly enclosing within a metallic shield, said terminal module assembly including:

a first terminal module with a plurality of first contacts embedded within a first insulator via a first stage insert-molding process;

a second terminal module with a plurality of second contacts embedded within a second insulator via another first stage insert-molding process;

the first insulator and the second insulator being secured to each other with a metallic shielding plate sandwiched therebetween in a vertical direction; and a third insulator applied upon all the first terminal module, the second terminal module and the shielding plate via a second stage insert-molding process; wherein the second insulator prior to being secured to the first insulator engages the shielding plate;

the shielding plate has a cutout at a front end thereof, and one of the first insulator and the second insulator includes a resilient pressing part extending through the cutout in the vertical direction for engagement with the shielding plate; and one of the first insulator and the second insulator includes an engagement device extending through the cutout in the vertical direction for engagement with the other.

2. The electrical connector as claimed in claim 1, wherein said engagement device is an engagement block to be received in an engagement hole formed in the other.

3. The electrical connector as claimed in claim 1, wherein the shielding plate has a top surface facing the first insulator and a bottom surface facing the second insulator, and the resilient pressing part is disposed on the second insulator and has a hook downwardly pressing the top surface of the shielding plate.

4. An electrical connector comprising:

a terminal module assembly enclosing within a metallic shield, said terminal module assembly including:

a first terminal module with a plurality of first contacts embedded within a first insulator via a first stage insert-molding process;

a second terminal module with a plurality of second contacts embedded within a second insulator via another first stage insert-molding process, the second insulator having a deflectable pressing part with a hook at a free end thereof;

the first insulator and the second insulator being secured to each other with a metallic shielding plate sandwiched therebetween in a vertical direction; and a third insulator applied upon all the first terminal module, the second terminal module and the shielding plate via a second stage insert-molding process; wherein the second insulator and the metallic shielding plate is originally discrete from each other, and the shielding plate is assembled upon the second insulator of the second terminal module in the vertical direction and secured thereto via said hook in said vertical direction.

5. The electrical connector as claimed in claim 4, wherein said hook is engaged with a side edge of the shielding plate.

6. The electrical connector as claimed in claim 5, wherein said side edge is formed around a cutout of the shielding plate.

7. The electrical connector as claimed in claim 6, wherein said cutout is formed around a front end region of the shielding plate.

8. The electrical connector as claimed in claim 4, wherein one of said first insulator and said second insulator includes a first engaging device and the other includes a second engaging device to secure said first engaging device for securing the first insulator and said second insulator together in the vertical direction.

9. The electrical connector as claimed in claim 8, wherein said first engaging device is an engaging block, and said second engaging device is an engaging hole.

10. The electrical connector as claimed in claim 8, wherein all said pressing part and said first engaging device and said second engaging device are located around a front end of the terminal module assembly.

11. The electrical connector as claimed in claim 8, wherein the shielding plate forms a cutout in a front region through which at least one of said first engaging device and said second engaging device extends in the vertical direction.

12. The electrical connector as claimed in claim 11, wherein said pressing part extends through the cutout.

13. A method of making an electrical connector comprising steps of:

providing a first terminal module with a plurality of first contacts retained in a first insulator via a first stage insert-molding process;

providing a second terminal module with a plurality of second contacts retained in a second insulator via another first stage insert-molding process;

providing a metallic shield plate;

providing a first interengaging means between the second insulator and the shielding plate;

providing a second interengaging means between the second insulator and the first insulator;

assembling the shielding plate upon the second insulator via engagement between the second insulator and the shielding plate;

assembling the first insulator upon the shielding plate via engagement between the first insulator and the second insulator wherein the shielding plate is sandwiched between the first insulator and the second insulator in a vertical direction; and applying a third insulator upon all the first terminal module, the second terminal module and the shielding plate via a second stage insert-molding process to form a terminal module assembly; wherein the shielding plate includes a cutout around a front end region, and the first interengaging means includes a deflectable pressing part extending from the second insulator through the cutout with a hook at an end to engage a side edge of the shielding plate beside the cutout.

* * * * *